United States Patent [19]

Bühler

[11] 4,009,000

[45] Feb. 22, 1977

[54] PROCESS FOR THE DYEING OR PRINTING AND SIMULTANEOUS FINISHING OF CELLULOSE MATERIALS

[75] Inventor: Hermann Bühler, Reinach, Basel-Land, Switzerland

[73] Assignee: Ciba-Geigy Corporation, Ardsley, N.Y.

[22] Filed: Dec. 19, 1973

[21] Appl. No.: 426,273

[30] Foreign Application Priority Data

Dec. 21, 1972 Switzerland ..... 18661/72

[52] U.S. Cl. ..... 8/17; 8/116.4; 260/29.2 N; 260/29.4 R

[51] Int. Cl.[2] ..... D06P 3/58; D06P 3/60; D06P 3/68

[58] Field of Search ..... 8/17, 116.4; 260/29.2 N, 29.4 R

[56] References Cited

UNITED STATES PATENTS

| | | | |
|---|---|---|---|
| 3,046,075 | 7/1962 | Kantner et al. | 8/17 |
| 3,130,001 | 4/1964 | Fenner et al. | 8/17 |
| 3,411,863 | 11/1968 | Guthrie et al. | 8/17 |
| 3,501,259 | 3/1970 | Long | 8/54.2 |
| 3,679,348 | 7/1972 | Asahi et al. | 8/116.4 |
| 3,706,526 | 12/1972 | Swidler et al. | 8/116.4 |
| 3,709,657 | 1/1973 | Hollies et al. | 8/116.4 |
| 3,837,799 | 9/1974 | Wilson et al. | 8/116.4 |
| 3,841,832 | 10/1974 | Swidler et al. | 8/116.4 |

FOREIGN PATENTS OR APPLICATIONS

| | | | |
|---|---|---|---|
| 257,087 | 5/1963 | Australia | 8/18 |
| 2,118,994 | 8/1972 | France | 8/17 |
| 2,163,897 | 7/1972 | Germany | 8/17 |
| 1,017,610 | 1/1966 | United Kingdom | 8/17 |

OTHER PUBLICATIONS

Diserens, The Chemical Technology of Dyeing and Printing, vol. II, Reinhold Pub. Co., N.Y., N.Y., 1951, pp. 2, 3, 5, 56–60, 95, 304, 326, 333–337.

*Primary Examiner*—Ronald W. Griffin
*Attorney, Agent, or Firm*—Joseph G. Kolodny; Edward McC. Roberts; Prabodh I. Almaula

[57] ABSTRACT

A process for the dyeing or printing and simultaneous finishing of cellulose materials is described, in which process these materials are impregnated with an aqueous liquor comprising a specific dyestuff which contains at least one hydroxyalkyl radical or a cycloalkyl radical having at least one hydroxyl group, a synthetic resin-forming intermediate, formaldehyde or an agent releasing formaldehyde, an acid catalyst and, optionally, further additives, then dried, steamed or cold-stored, and finally subjected to a treatment at elevated temperature and, optionally, subsequently rinsed.

Dyed cellulse materials are obtained which have very high dyestuff yields, and which are dyed and printed evenly and fast to light and to washing; the resulting finishing effect is not strong and hence the effect on the handle of the material less, a condition which is particularly desirable in the case of light fabrics and therefore of great advantage.

16 Claims, No Drawings

PROCESS FOR THE DYEING OR PRINTING AND SIMULTANEOUS FINISHING OF CELLULOSE MATERIALS

The present invention relates to a process for the dyeing or printing and simultaneous finishing of cellulose materials, to the preparations used for the carrying out of this process, as well as to the thus dyed or printed and finished cellulose material, as an industrial product.

In the Swiss Patent Specification, No. 575,504 (Application No. 18961/71), a process for the dyeing or printing and simultaneous finishing of cellulose materials is described, in which process these materials are impregnated with an aqueous liquor containing a. at least one dyestuff, particularly an azo or anthraquinone dyestuff, having at least one bis(hydroxyalkyl-)amino grouping on a pyrimidine or triazine ring, which ring is bound by way of an amino group to the dyestuff molecule, b. a synthetic-resin-forming intermediate, c. an acid catalyst, and d. optionally further additives, subsequently squeezed out, dried, steamed or cold-stored, and subsequently heated for about 30 seconds to 30 minutes at ca. 100° to 220° C, after which process a subsequent washing of the material treated in this manner is not absolutely necessary.

It has now been found that, by addition of formaldehyde or of an agent releasing formaldehyde to the aqueous treatment liquor, the amount of synthetic-resin-forming intermediate can be reduced by about half. The strong dyeings or printings obtained by this method have a finish which is inevitably weaker than that obtained with the larger amount of synthetic-resin-forming intermediate, but without formaldehyde. This weaker finish is however in some cases desirable, particularly on light fabric, since a strong finish changes the nature of the material too much, especially the handle. But to reduce the amount of synthetic-resin-forming intermediate without the addition of formaldehyde is not possible, as in this case the result would be a poorer fixing of the dyestuff.

The process according to the invention for the dyeing or printing and simultaneous finishing of cellulose materials is a process in which these materials are impregnated with an aqueous liquor containing a. at least one dyestuff of formula I $$(W)_{m-1} - D - [\ A - X\ ]_n \qquad \text{(I)}$$

wherein

W represents an $SO_3H$ group or a COOH group,

D represents a chromophoric radical of a formazan, azomethine or nitro dyestuff, and preferably of an azo, anthraquinone or phthalocyanine dyestuff, A represents a bridge member, X represents at least one hydroxyalkyl radical or a cycloalkyl radical having at least one hydroxyl group, and $m$ and $n$ denote integers of 1 to 5, b. a synthetic-resin-forming intermediate soluble or at least dispersible in water, c. formaldehyde or an agent releasing formaldehyde, d. an acid catalyst, and e. optionally further additives, dried, steamed or cold-stored, and thereupon subjected to a treatment at elevated temperature and, optionally, subsequently rinsed.

If a printing paste is used, it can contain, as further additives, the usual thickeners such as starch and starch ether, tragacanth or methylcellulose, particularly, however, alginates such as sodium alginate.

Preferred dyestuffs correspond to formula II $$(W)_{m-1} - D - [\ A_1 - X_1\ ]_n \qquad \text{(II)}$$

wherein $W$, $D$, $m$ and $n$ have the meaning given under formula I, $X_1$ represents a hydroxyalkyl radical having 2 to 10 carbon atoms, or a cyclohexyl radical having at least one hydroxyl group, and $A_1$ represents a heterocyclic-aromatic radical, a substituted amino, carbonamido or sulphonamido radical, or an alkyleneamino-carbonyl radical, or an $-SO_2$-group or an -NHCO-group.

Further suitable dyestuffs are those of formula III $$(W)_{m-1} - D - [\ A_2 - X_1\ ]_n \qquad \text{(III)}$$

wherein

W, D, $X_1$, $m$ and $n$ have the meaning given under formulae I and II, and $A_2$ corresponds to the groups $-NX_1-$, $-SO_2NX_1-$, $-CONX_1-$, $-(CH_2)_pNHCOX_1-$, or to the formulae

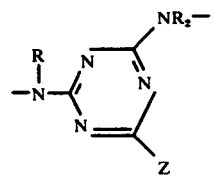

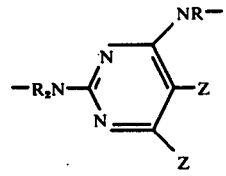

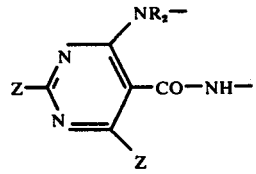

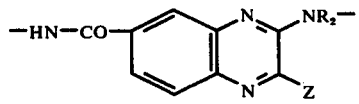

or

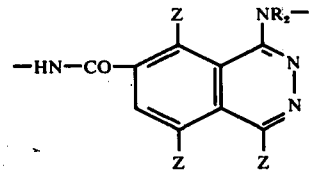

wherein $X_1$ has the meaning given under formula II, p denotes 1 or 2,

R represents a hydrogen atom or an alkyl group having 1 to 4 carbon atoms, and $R_2$ represents a hydrogen atom, or an alkyl group having 1 to 6 carbon atoms, such as methyl, ethyl, propyl and butyl, which, in their turn, can be further substituted with, e.g. one or more hydroxyl, methoxy or ethoxy groups.

$R_2$ can also represent a cycloalkyl radical having at least one hydroxyl group, such as, for example, mono- or dihydroxycyclohexyl, and Z represents a hydrogen atom or a hydroxyl or thiocyanato group, a lower alkyl group such as methyl or ethyl; a halogen atom such as chlorine and bromine; monocyclic aryl groups such as phenyl and tolyl; alkoxy groups such as methoxy and ethoxy; aryloxy groups such as the monocyclic aryloxy groups, such as phenoxy and sulphophenoxy; lower alkylmercapto groups such as methyl- and ethylmercapto; arylmercapto groups such as phenyl- or tolylmercapto; amino and substituted amino groups such as mono- and disubstituted alkylamino groups having 1 to 4 carbon atoms per alkyl radical; hydroxyalkylamino groups such as hydroxyethylamino and dihydroxyethylamino; also phenylamino, sulphophenylamino, disulphophenylamino, naphthylamino, sulphonaphthylamino, disulphonaphthylamino, benzylamino and cyclohexylamino.

Also of interest are dyestuffs of formula IV

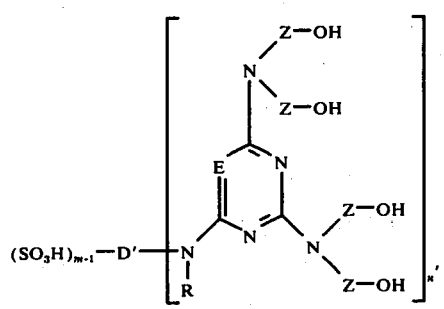

(IV)

wherein

R has the meaning given under formula III, and

D′ represents the radical of an azo or anthraquinone dyestuff, E represents

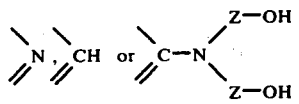

Z independently represents an alkylene radical having 2 to 5 carbon atoms, $n'$ denotes the number 1 or 2, and $m$ has the meaning given in formula I.

As radical of an azo dyestuff, D or D′ represents, for example, the radical of a metal-free or metal-containing monoazo, disazo and polyazo dyestuff.

To be mentioned among the anthraquinones are the 1,4-diamino-anthraquinones, e.g. those that are further substituted on at least one amino group.

In the case of the phthalocyanine dyestuffs, these are complex compounds with heavy metals such as manganese, cobalt and nickel, preferably however copper.

The dyestuffs usable according to the invention are prepared in a known manner. Thus, for example, the azo and anthraquinone dyestuffs of formula IV are obtained by reaction of the corresponding di- or trihalogen-, advantageously -chloro-triazine- or -pyrimidine-azo- and -anthraquinone dyestuffs with dihydroxyalkylamines, particularly diethanolamine.

Depending on the desired depth of colour of the material, the dyestuffs are used in amounts of about 10 to 100 g/l of liquor, and especially in amounts of between 40 and 80 g/l of liquor.

The synthetic-resin-forming intermediates, which should be soluble or dispersible in water, are known from the literature, or are used in the industry for obtaining the crease-proof or handle-modifying finish on textiles. The following examples are given: epoxides, polyisocyanates, condensation products from formaldehyde with phenols, cresols or acrolein, as well as mixtures containing the methylol derivatives or lower alkyl ethers of methylol derivatives of monomeric or polymeric compounds which, in their turn, contain a large number of amino or monosubstituted amino groups, whereby the mentioned compounds are known or are employed in practice for the formation of resins by condensation with formaldehyde. Suitable compounds are, for example, monomeric nitrogen compounds such as urea, thiourea, substituted ureas such as alkyl or aryl urea, and thioureas such as alkyleneureas or alkylenediureas, e.g. dihydroxyethyleneurea also known as 4,5-dihydroxyimidazolidone-2, ethyleneurea, propyleneurea, oxypropyleneurea and acetyleneurea, dicyandiamide, dicyandiamidine, diguanides, amides and heterocyclic compounds, such as urones, ureides, melamines, oxydiaminotriazines, dioxyaminotriazines, triazones such as N-ethyltriazone, guanamines and hydantoins, or mixtures of such compounds and polymeric nitrogen compounds, such as the polymeric amides obtained by reaction of dibasic acids with diamines. The lower alkyl ethers of methylol derivatives of these compounds are, for example, methyl, ethyl, propyl and butyl ether. Particularly suitable, for the purpose of enhancing the creasing resistance of textiles, are tetramethylolacetylurea, melamine-formaldehyde resin and, in particular, N,N′-dimethyloldihydroxyethyleneurea. It is also possible to use those synthetic-resin-forming intermediates which are dispersible in water, optionally with the aid of a dispersing agent. Preferably, however, the compounds concerned are soluble in water, whereby the solubility in water need not be absolutely unlimited: for instance, such compounds are also suitable which only in specific proportions with water give a homogeneous solution.

In general, particularly valuable products are produced by products methylolated to the highest possible degree.

It is also possible to use mixtures of various synthetic-resin-forming intermediates.

It is advantageous to use the synthetic-resin-forming intermediates in the form of their aqueous solutions and in amounts of about 20 to 60 g of active substance per liter of liquor.

The formaldehyde or agents releasing formaldehyde are used, for example, in the following forms: formaldehyde as such in the form of aqueous, e.g. 20–40%, solutions (Formalin); suitable agents releasing formaldehyde are, in particular, polymeric forms, i.e. those with a degree of polymerisation of at most 100, of formaldehyde, such as, e.g. α-trioxymethylene (1,3,5-trioxane) or tetraoxymethylene (tetroxocane), as well as polymethylenes, such as, e.g. ω, ω'-dihydroxypolyoxymethylene. These substances are used in the form of their aqueous solutions.

The best results are obtained with amounts of about 5 to 30% of active substance, relative to the amount of dyestuff.

Examples of suitable acid catalysts usable according to the invention are the salts formed from weak bases and mineral acids, such as, for example, zinc chloride, zinc nitrate, ammonium salts such as ammonium sulphate, ammonium chloride, ammonium dihydrogen phosphate, mineral acid salts or organic amines, such as ethanolamine hydrochloride, weak acids, e.g. organic acids, such as oxalic acid, and neutral substances which generate acidity during the heating or the steaming treatment, such as magnesium chloride and ammonium thiocyanate. The acid catalysts are advantageously used in amounts of ca. 0.1 to 5%, preferably 0.5 to 2%, relative to the weight of liquor.

The aqueous dye liquor can contain further additives common in dyeing; if desired, these can be, for example: agents improving the "handle", such as polyhydroxy compounds, e.g. polyvinyl alcohols, polyvinyl acetates, cellulose ethers, starch and starch ethers, protein-like substances such as casein and gelatine; softening agents such as the those commonly used in textile finishing, e.g. silicone compounds, as well as agents repelling dirt, water and oil, such as methacrylic acid resins or sarcosite polyphosphates, or the usual fluorine compounds, as well as, finally, fire-proofing agents, and wetting or dispersing agents, such as, e.g. ethylene oxide reaction products with fatty acids, fatty amines or fatty alcohols.

The aqueous dye liquor can be applied in the known manner to the cellulose material. For example, it can be applied locally by printing the material with the aqueous liquor in the form of a printing paste; or it can be applied to the whole surface of the material, e.g. by impregnation, advantageously at temperatures of between ca. 20° and 50° C, and subsequent squeezing out to give a liquor absorption of about 60 to 80%.

The process is suitable, in particular, for the continuous method of operation, e.g. for the printing of fabrics in roller printing, or for impregnation in the padding machine.

Impregnation is advantageously performed in a single stage and with an aqueous liquor containing, at the same time, the dyestuff, the synthetic-resin-forming intermediate, formaldehyde or an agent releasing formaldehyde, the acid catalyst and, optionally, further additives. It can also be performed, however, in a modified process comprising two stages: in this case, the cellulose material is firstly treated with an aqueous liquor containing only the dyestuff and subsequently squeezed out to about 60 to 80% liquor content; the thus pretreated dyed cellulose material is then optionally dried, subsequently impregnated with an aqueous liquor containing the synthetic-resin-forming intermediate, formaldehyde or agents releasing formaldehyde, the acid catalyst and, optionally, further additives; and afterwards again squeezed out to ca. 60 to 80%.

The cellulose material impregnated in this manner is then dried, for example, for 1 to 15 minutes at a temperature of between 50 and 100° C, or, optionally after an intermediate drying, subjected to a steaming process. As a rule, the wet material, particularly regenerated cellulose material, is transferred to the steaming chamber and steamed with saturated steam at atmospheric pressure for 3 to 30 minutes, or with saturated steam at a higher temperature for a correspondingly shorter period of time.

A further possibility, particularly for regenerated cellulose materials such as spun rayon, is for the impregnated material to be stored cold, e.g. for 8 to 48 hours, especially 24 hours, at room temperature. Either after steaming or after cold storage, the material can, optionally, be subsequently dried, e.g. for 1 to 15 minutes at 50° to 100° C.

The cellulose material is then subjected direct to a heat treatment at temperatures of 100° to 220° C, preferably 140° to 180° C. This hardening process, which can take from 30 seconds to 30 minutes, depending on the mode of heat generation and temperature range, serves particularly to effect the fixing of the dyestuff and of the synthetic-resin-forming intermediate on the cellulose material.

Subsequent to the hardening treatment, the dyed or printed cellulose material can be rinsed in the usual manner in order to remove slight traces of unfixed dyestuff and/or synthetic resin or catalyst. For this purpose, the substrates are treated, e.g. at 40° to 80° C, in a solution containing soap or a synthetic detergent, e.g. an ethylene oxide addition product of an alkylphenol or the sodium salt of 2-heptadecyl-N-benzylbenzimidazole disulphonic acid. In most cases, however, the dyed or printed cellulose material requires no subsequent rinsing.

Suitable cellulose material is, in particular, that made from natural or regenerated cellulose. The following may be mentioned: cotton, hemp, linen and jute, as well as viscose and cellulose acetate fibres and spun rayon. The fibre material can be treated at any stage of processing, and can be, for example, in the form of loose material, or in the form of filaments, yarns, fabrics or knitwear, or as mixtures thereof.

The cellulose materials treated by the present process are obtained with very high dyestuff yields and they are dyed and printed evenly and are fast to light and to washing; the resulting finishing effect is not strong and hence the effect on the handle of the material less, a condition which is particularly desirable in the case of light fabrics and therefore of great advantage.

The fabrics display moreover further finishing effects, depending on the nature and amount of the other additives used, such as, e.g. improvement of the handle, resistance to shrinking, resistance to creasing in the dry and wet state, or hydrophobic properties.

To be particularly emphasised is the high fixing yield of the dyestuffs (in most cases over 90%), a factor which is ecologically advantageous.

In addition, the present invention relates to the preparations for carrying out this process, which contain a. at least one dyestuff of formula I $$(W)_{m-1} - D - [A - X]_n \qquad (I)$$

wherein

W represents an $SO_3H$ group or a COOH group,

D represents a chromophoric radical of a formazan, azomethine or nitro dyestuff, or of an azo, anthraquinone or phthalocyanine dyestuff, A represents a bridge member, X represents at least one hydroxyalkyl radical, or a cycloalkyl radical having at least one hydroxyl group, and

*m* and *n* denote integers of 1 to 5, b. a synthetic-resin-forming intermediate soluble or at least dispersible in water, c. formaldehyde or an agent releasing formaldehyde, d. an acid catalyst, and e. optionally further additives.

The following examples are intended to further illustrate the invention, without this being limited to them. Where not otherwise stated in the examples, the term 'parts' denotes parts by weight, and percentages are expressed in per cent by weight. The temperatures are in degrees Centigrade.

EXAMPLE 1

Cotton fabric is impregnated at a temperature of 20 to 25° with an aqueous liquor containing, per 1000 ml, 50 g of the dyestuff of the formula

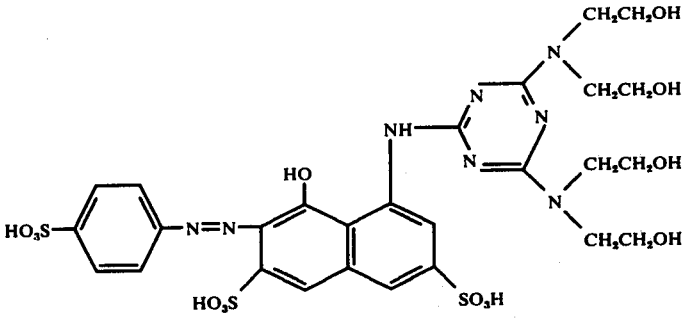

50 g of a 50% aqueous solution of N,N'-dimethyloldihydroxyethylene urea, 5 g of trioxane and 20 g of zinc nitrate; the impregnated cotton fabric is subsequently squeezed out to a liquor content of ca. 70%, relative to the dry weight of the material, dried for 4 minutes at 80° and then heated for 4 minutes at 150°. The material is afterwards rinsed and dried.

The result is a deeply coloured bluish-red cotton dyeing, fast to light and washing, with a crease-proof finish and a dyestuff fixing value of over 95%. Without the addition of the agent releasing formaldehyde (trioxane), with otherwise the same procedure, the dyestuff fixing value is only ca. 60%.

If, instead of 50 g of the 50% aqueous solution of N,N'-dimethyloldihydroxyethyleneurea, 60 g of a 50% aqueous solution of one of the synthetic-resin-forming intermediates listed in the following Table I is used, and instead of 20 g of zinc nitrate, the catalysts given in Table II employed in the stated amounts, then there are obtained, with otherwise the same procedure as that described in the example, similarly deeply coloured and finished bluish-red cotton dyeings.

Table I

| Synthetic-resin-forming intermediates |
|---|
| N,N-dimethylolpropyleneurea |
| N,N-dimethylolhydroxypropyleneurea |
| tetramethylolacetyleneurea |
| dimethylol-N-ethyltriazone |

Table II

| | Catalysts |
|---|---|
| 12 g/l | ammonium chloride |
| 15 g/l | magnesium chloride |
| 10 g/l | ammonium thiocyanate |
| 12 g/l | ammonium dihydrogen phosphate |
| 15 g/l | ethanolamine hydrochloride |

EXAMPLE 2

Cotton fabric is impregnated at a temperature of 20 to 25° with an aqueous liquor containing, per 1000 ml, 50 g of the dyestuff of the formula

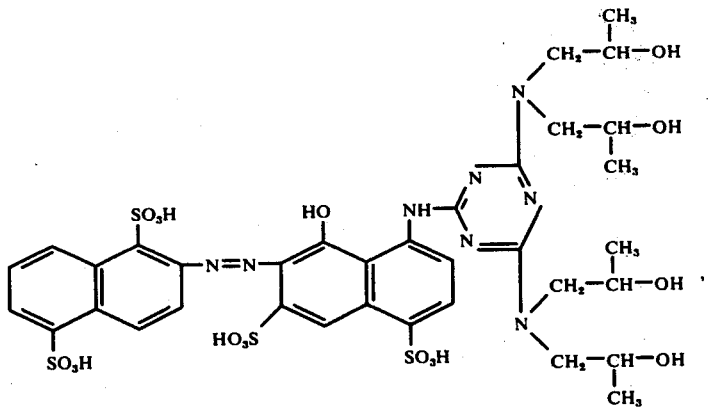

and is then squeezed out to give a liquor content of ca. 60% relative to the dry weight of the material; the material is subsequently impregnated a second time with an aqueous liquor containing this time, per 1000 ml, 40 g of a 50% aqueous solution of a melamine formaldehyde resin, 10 g of tetroxocane and 20 g of magnesium chloride; it is afterwards squeezed out to 75% liquor content, dried for 3 minutes at 90°, and then heated for 3 minutes at 160°. The treated cotton fabric is subsequently rinsed, soaped in boiling solution for 20 minutes, again rinsed, and finally dried.

An intensely red cotton dyeing having a crease-proof finish and fastness to light and to washing is thus obtained (dyestuff yield practically quantitative).

ous solution of a urea-formaldehyde resin is used, and the material heated not for 5 minutes at 140° but for 30 seconds at 210°, the procedure otherwise being the same as that described in the example, then there is obtained a similarly finished, deeply coloured yellow cotton dyeing.

EXAMPLE 4

Cotton fabric is impregnated at a temperature of 30° with an aqueous liquor containing, per 1000 ml, 40 g of the dyestuff of the formula

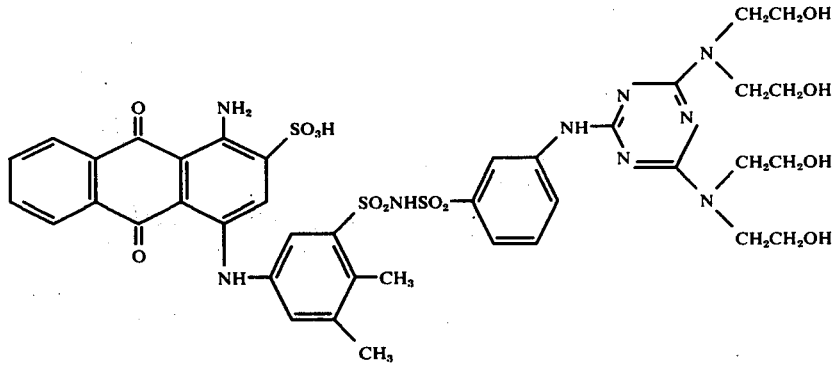

EXAMPLE 3

Cotton fabric is impregnated at a temperature of 25 to 30° with an aqueous liquor containing, per 1000 ml, 40 g of the dyestuff of the formula 80 g of a 50% aqueous solution of N,N'-dimethylolethyleneurea, 10 ccm of a 70% aqueous solution of ω,ω'-dihydroxypolyoxymethylene and 15 g of zinc chloride; the material is subsequently squeezed out to a

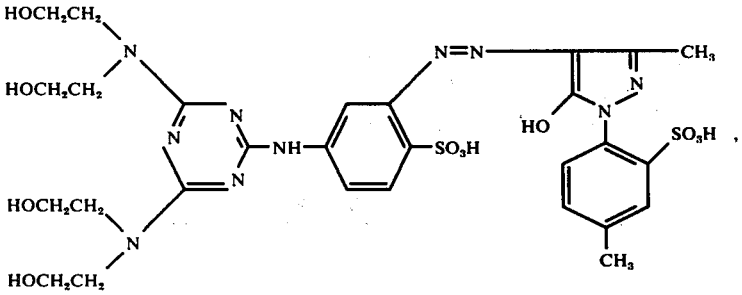

55 g of a 50% aqueous solution of N,N'-dimethyloldihydroxyethyleneurea, 20 ccm of a 35% aqueous formaldehyde solution and 18 g of magnesium chloride; it is then squeezed out to a liquor content of ca. 60%, dried for 6 minutes at 70° and subsequently heated for 5 minutes at 140°. The cotton fabric is afterwards rinsed and dried.

An intensely yellow cotton dyeing is obtained (dyestuff yield 94%).

If, instead of 55 g of a 50% aqueous solution of N,N'-dimethyloldihydroxyethyleneurea, 65 g of a 50% aqueous liquor content of 65%, dried for 3 minutes at 95° and then heated for 2 minutes at 180°.

An intensely blue cotton dyeing having good fastness to light is obtained.

If, instead of 15 g of zinc chloride, 16 g of ammonium sulphate is used, and instead of 40 g of the dyestuff of the above formula, the same amount in each case of the dyestuffs listed in column II of the following Table III employed, the procedure otherwise being the same as that described in the example, then there are obtained deeply coloured, finished cotton dyeings in the shades given in column III.

Table III
| I Example No. | II Dyestuff | Cotton fabric is impregnated at a temperature of 30° with an aqueous liquor containing, per 1000 ml, 50 g of the dyestuff of the formula | cotton |
|---|---|---|---|
| 5 | 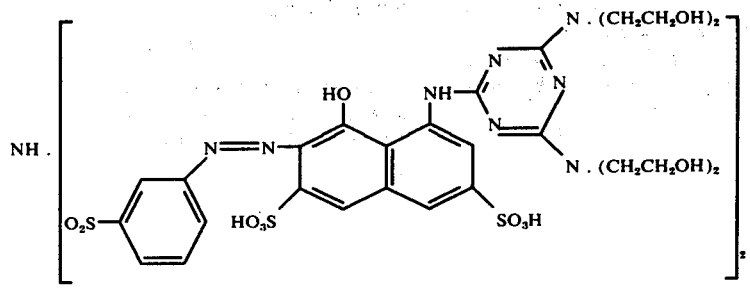 | | bluish-red |
| 6 | 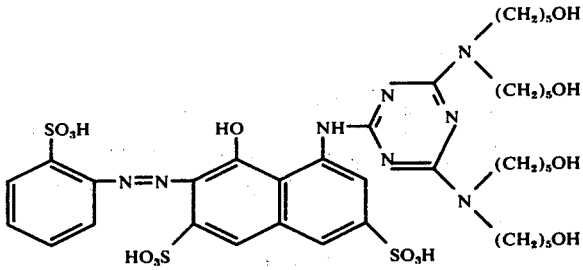 | | red |
| 7 | 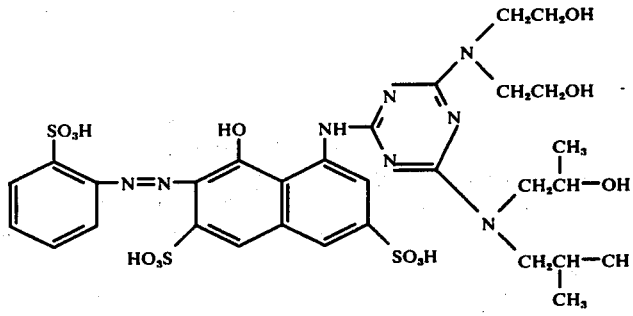 | | red |
| 8 | 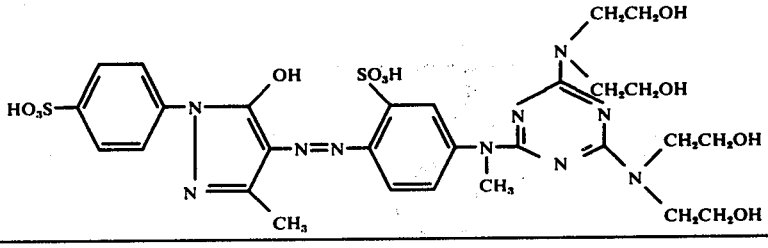 | | yellow |
EXAMPLE 9

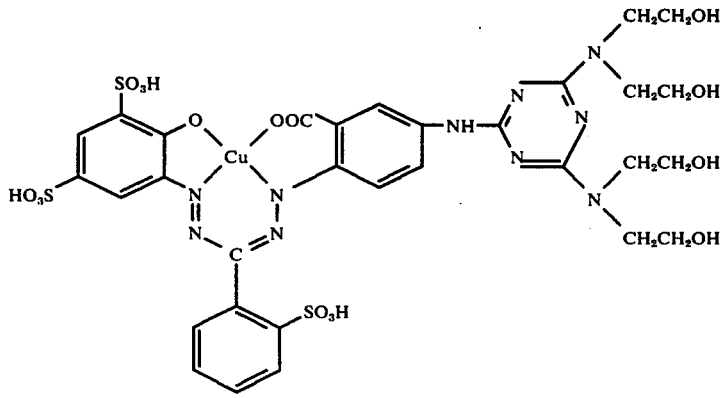

120 g of a 50% aqueous solution of N,N'-dimethylolethyleneurea, 10 g of tetroxocane, 15 g of zinc chloride and 20 g of starch; the impregnated cotton fabric is then squeezed out to a liquor content of 65%, dried for 3 minutes at 95° and subsequently heated for 2 minutes at 180°. The cotton fabric is afterwards rinsed, soaped for 10 minutes in boiling solution, again rinsed, and finally dried.

There is obtained by this procedure a deeply coloured blue cotton dyeing having good fastness to washing and to light and also a modified handle.

EXAMPLE 10

Cotton fabric is impregnated at a temperature of 20° to 25° with an aqueous liquor containing, per 1000 ml, 40 g of the dyestuff of the formula

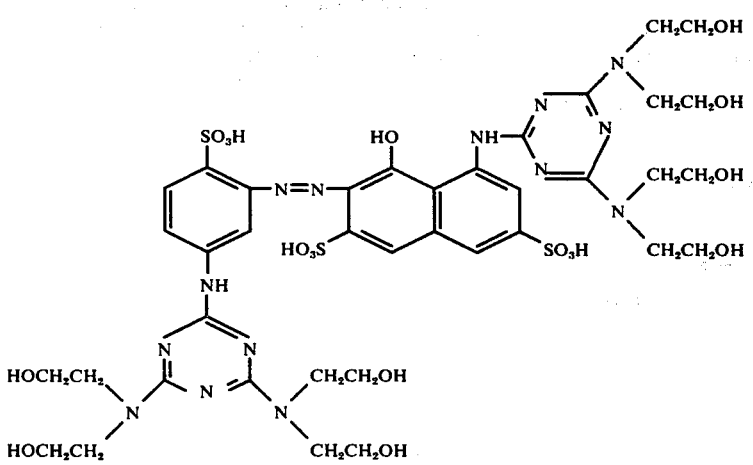

75 g of a 50% aqueous solution of N,N'-dimethyloldihydroxyethyleneurea, 12 g of the compound

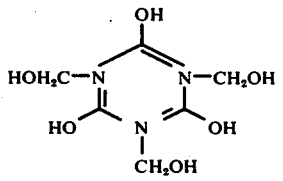

20 g of zinc nitrate and 25 g of polyvinyl alcohol; the impregnated cotton fabric is then squeezed out to a liquor content of ca. 70% relative to the dry weight of the material, dried for 4 minutes at 80°, and subsequently heated for 4 minutes at 150°. The cotton fabric is afterwards rinsed and dried.

A deeply coloured red cotton dyeing having a modified handle is obtained.

EXAMPLE 11

If, instead of the components mentioned in Example 1, 80 g of the dyestuff of the formula

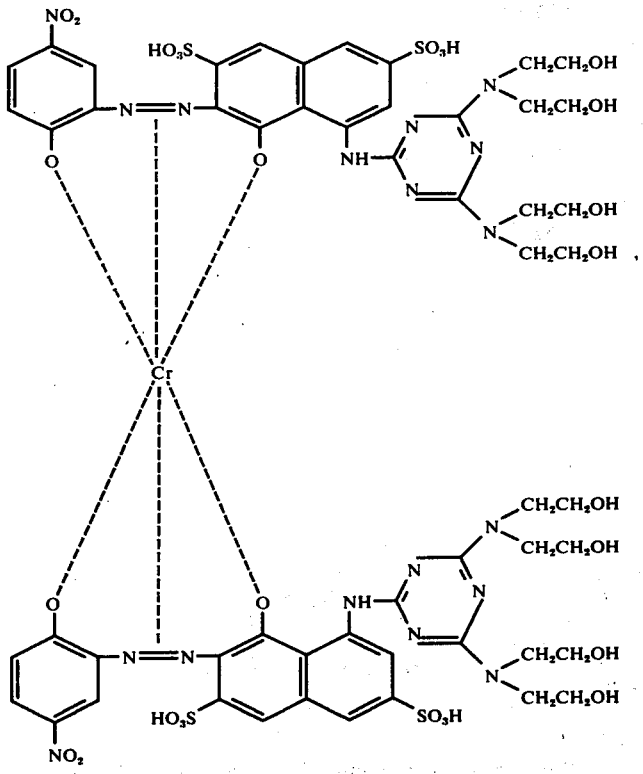

120 g of N,N'-dimethyloldihydroxyethyleneurea as a 50% aqueous solution, 25 ml of a 35% aqueous formaldehyde solution and 12 g of ammonium sulphate are used, the procedure otherwise being as described in Example 1, then there is obtained a deeply coloured black cotton dyeing having fastness to washing and to light.

EXAMPLE 12

Cotton fabric is impregnated at a temperature of 30° with an aqueous liquor containing, per 1000 ml, 60 g of the dyestuff of the formula

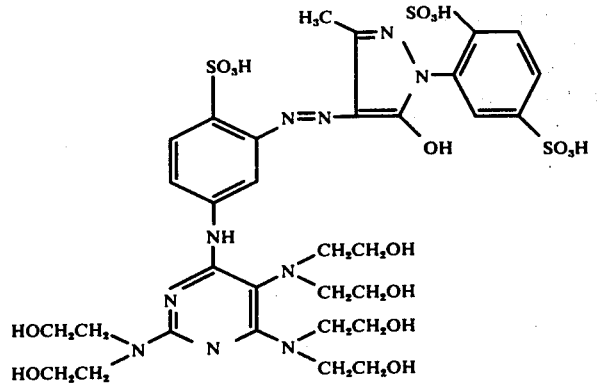

85 g of a 50% aqueous solution of tetramethylolacetylenurea, 9 g of the compound

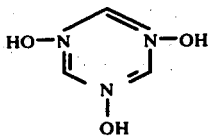

and 12 g of ammonium dihydrogen phosphate; the impregnated cottom fabric is then squeezed out to a liquor content of ca. 65% relative to the dry weight of the material, dried for 3 minutes at 90° and subsequently heated for 3 minutes at 170°. The material is afterwards rinsed and dried.

There is thus obtained a deeply coloured yellow cotton dyeing having a crease-proof finish and fastness to light and to washing.

EXAMPLE 13

If, instead of of the dyestuff mentioned in Example 12, 40 g of the dyestuff of the formula

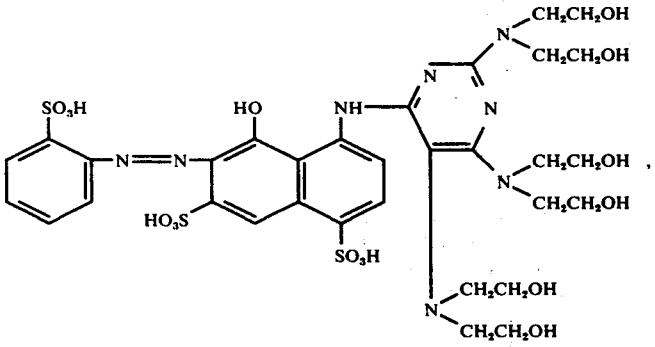

is used, the procedure otherwise being as described in Example 12, then there is obtained a deeply coloured red cotton dyeing having a crease-proof finish and fastness to washing.

EXAMPLE 14

A printing paste of the following composition is prepared:

40 g of the dyestuff of the formula

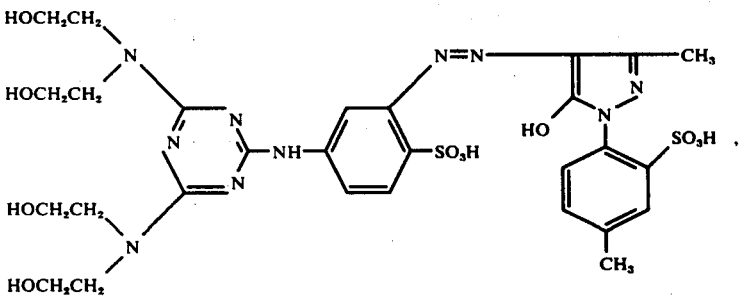

100 g of melamine-formaldehyde resin (50%)
10 g of trioxane
400 g of sodium alginate as a 5% solution
20 g of ammonium sulphate
430 g of water
1000 g.

This printing paste is applied to cotton fabric, e.g. by means of stencils; it is dried and the fabric subsequently heated for 5 minutes at 160°. The printed cotton fabric is then rinsed, soaped for 10 minutes in boiling solution, again rinsed, and finally dried.

There is thus obtained on the printed areas a very intensely yellow dyed cotton fabric having a crease-proof finish.

EXAMPLE 15

A spun rayon fabric is impregnated at a temperature of 25° to 30° with an aqueous liquor containing per liter 40 g of the dyestuff of the formula

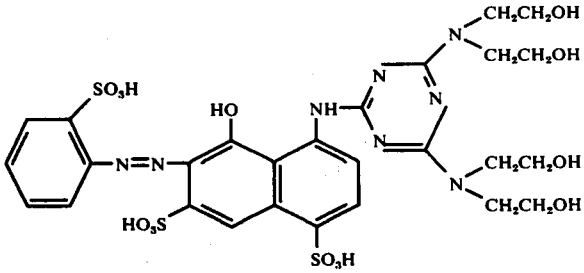

40 g of a 50% aqueous solution of N,N'-dimethyloldihydroxyethyleneurea,
15 ccm of a 25% aqueous formaldehyde solution, and
15 g of ammonium chloride;

the material is squeezed out to give about 70% increase of weight, steamed for 4 minutes at 103°, and then hardened for 4 minutes at 150°. It is afterwards rinsed and dried. A deeply coloured red spun rayon dyeing having fastness to light and washing is obtained.

EXAMPLE 16

A cotton fabric is impregnated at a temperature of 20° to 25° with an aqueous liquor containing per liter 50 g of the dyestuff of the formula

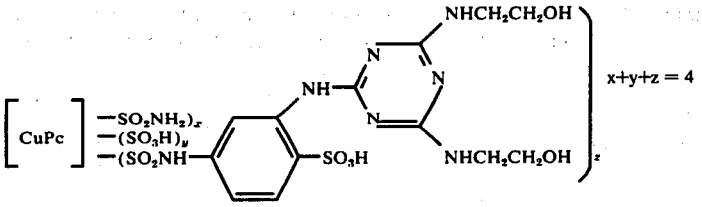

120 g of a 50% aqueous solution of N,N'-dimethyloldihydroxyethyleneurea,
12.5 g of trioxane, and
12 g of zinc chloride;

the material is then squeezed out to about 75% increase in weight, steamed for 5 minutes at 103° and subsequently hardened for 2 minutes at 170°. After rinsing and drying, there is obtained on the cotton fabric an intense turquoise dyeing which is fast to light and to washing and which also has a crease-proof finish.

Likewise suitable are identical amounts of the dyestuffs of the formulae (16a)

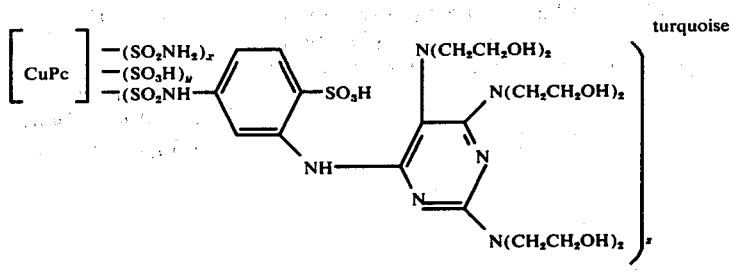

(16b)

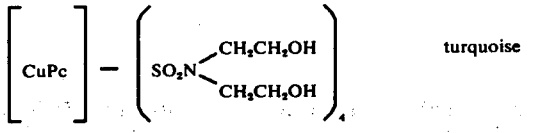

(16c)

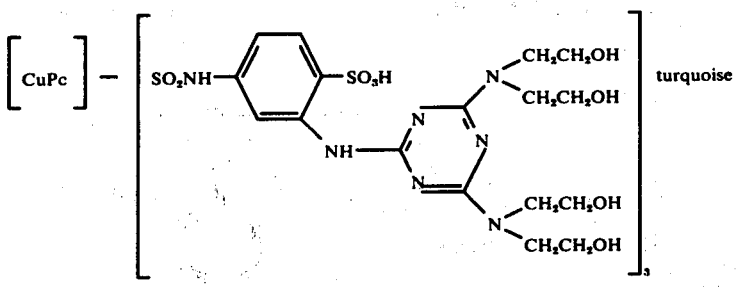

or (16d)

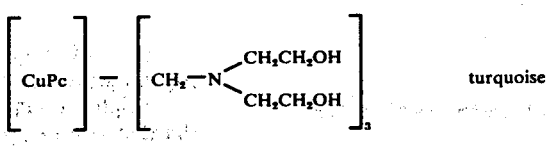

EXAMPLE 17

A cotton fabric is printed with a printing paste of the following composition: 40 g of the dyestuff formula

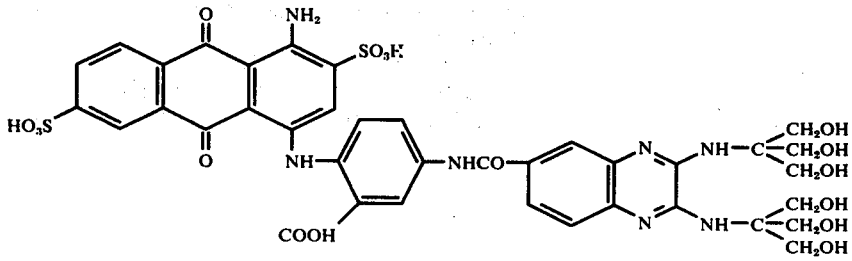

80 g of melamine-formaldehyde resin (50% aqueous),
10 g of tetroxocane,
400 g of sodium alginate as a 5% solution,
20 g of ammonium sulphate, and
450 g of water
1000 g The printed fabric is steamed for 5 minutes at 100° and subsequently hardened for 5 minutes at 150°. The result after washing and drying is a deeply coloured printing which is green-blue in colour and fast to light and to washing. In addition, the treated fabric has a crease-proof finish.

In place of the above given dyestuff, it is also possible to use the following dyestuff:

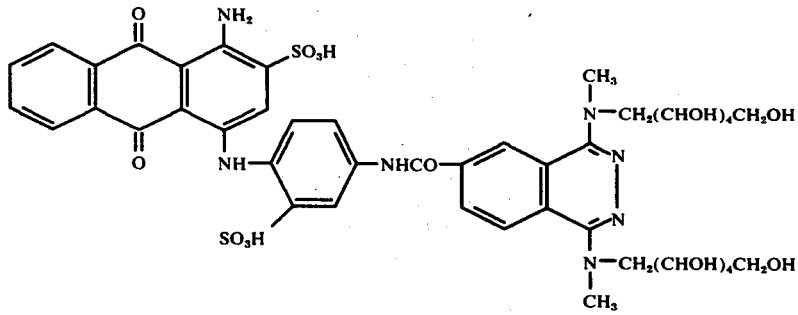

blue.

EXAMPLE 18

A spun rayon fabric is padded at a temperature of 25° with an aqueous liquor of the following composition:
50 g of the dyestuff of the formula

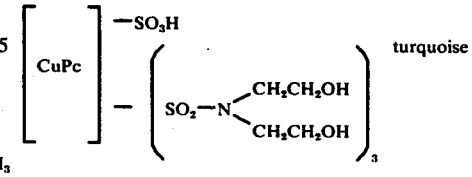

turquoise

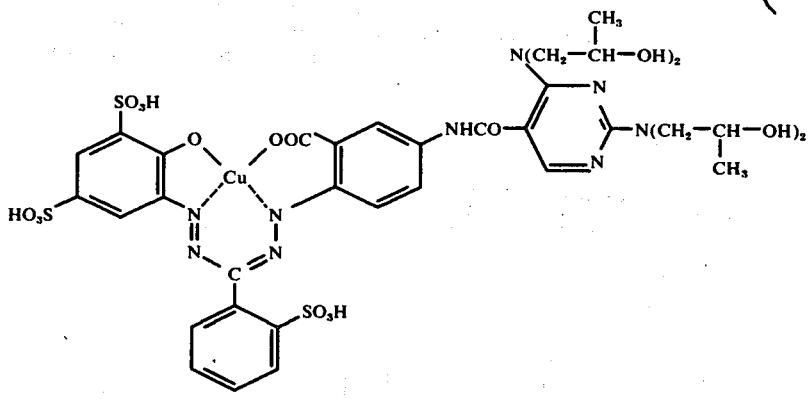

110 g of a 50% aqueous solution of tetramethylolacetylenurea,
20 g of a 50% aqueous solution of oligomeric formaldehyde,
12 g of ammonium dihydrogen phosphate, and
808 g of water
1000 g The impregnated fabric is squeezed out to leave a weight increase of 75%, then steamed for 3 minutes at 100° and hardened for a further 3 minutes at 170°. A subsequent washing is not necessary. A deeply coloured blue dyeing is obtained; the fabric moreover exhibits improved handle properties and has a crease-proof finish.

A dyestuff which is likewise suitable corresponds to the formula

CuPc = copper phthalocyanine.

EXAMPLE 19

A spun rayon fabric is impregnated at a temperature of 25° to 30° with an aqueous liquor containing, per 1000 ml, 40 g of the dyestuff of the formula

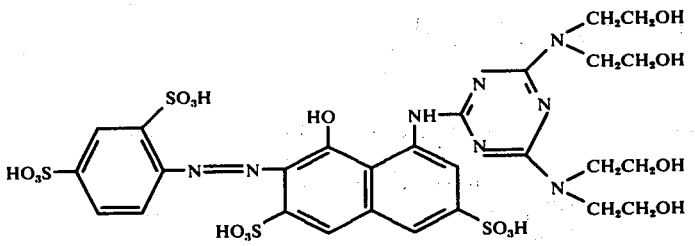

100 g of a 50% aqueous solution of N,N'-dimethylol-dihydroxyethyleneurea, 10 ml of a 20% formaldehyde solution and 15 g of ammonium chloride; the material is squeezed out to a liquor content of ca. 70%; it is stored for 24 hours at room temperature and then heated for 4 minutes at 150°. The fabric is subsequently rinsed and dried. The result is a deeply coloured bluish-red spun rayon dyeing: it is fast to light and to washing and has a crease-proof finish.

I claim:

1. A process for dyeing or printing and simultaneously finishing cellulose materials, comprising the steps of impregnating the cellulose material with an aqueous liquor containing a. 10 to 100 g/l of a dyestuff of the formula $(W)_{m-1} - D - [A - X]_n$ wherein W is an $SO_3H$ group or a COOH group, D is a chromophoric radical of a formazan, azomethine, nitro, azo, anthraquinone or phthalocyanine dyestuff, A is a bridge member selected from the group consisting of a heterocyclic-aromatic radical, a substituted amino, carbonamido or sulphonamido radical, or an alkyleneaminocarbonyl radical, or a $-SO_2-$ or a —NHCO— group, X is a monohydroxyalkyl radical of 2 to 10 carbon atoms having at least 2 carbon atoms between the hydroxy group and the bridge member, and *m* and *n* are integers of 1 to 5, b. 20 to 60 g/l of a water-soluble or water-dispersible synthetic-resin-forming intermediate selected from the group consisting of an aminotriazine-formaldehyde addition product, an oxydiaminotriazine-formaldehyde addition product, a dixoyaminotriazine-formaldehyde addition product, a triazone-formaldehyde addition product, a guanamine-formaldehyde addition product, a urea-formaldehyde addition product, a thiourea-formaldehyde addition product, an ethyleneurea-formaldehyde addition product, a dicyanodiamide-formaldehyde addition product, methylolmelamine, methylolurea, methylolethylene-urea at least partially etherified with a $C_1$–$C_5$-alkanol, methylolpropyleneurea at least partially etherified with a $C_1$–$C_5$-alkanol, methylolguanylurea at least partially etherified with a $C_1$–$C_5$-alkanol, methylolacetyleneurea at least partially etherified with a $C_1$–$C_5$-alkanol, and 4,5-dihydroxyimidiazolidone-2, c. 5 to 30% of the weight of the dyestuff of formaldehyde or a water soluble polymeric form of formaldehyde, and d. 1 to 50 g/l of an acid catalyst;

drying, steaming or cold-storing the impregnated material; and finally heating the material to fix the dyestuff thereon.

2. Process according to claim 1, wherein the impregnated material is dried at 50° to 100° C for 1 to 15 minutes, or steamed for 3 to 30 minutes, or stored for 8 to 48 hours at room temperature.

3. Process according to claim 2, wherein regenerated cellulose material is steamed for 3 to 30 minutes.

4. Process according to claim 2, wherein the impregnated material is dried and then is heated for 30 seconds to 30 minutes at 100° to 220° C.

5. Process according to claim 1, wherein the material receives no subsequent washing after the heating treatment.

6. Process according to claim 1, wherein the dyestuff is a metal complex of a mono or disazo dyestuff.

7. Process according to claim 1, wherein the dyestuff is a copper phthalocyanine dyestuff.

8. Process according to claim 1, wherein the dyestuff is a 1,4-diaminoanthraquinone.

9. Process according to claim 1, wherein element (c) is an aqueous 20-40% formaldehyde solution or 1,3,5-trioxane, or tetraoxymethylene.

10. Process according to claim 1, wherein the acid catalyst is a salt of a weak base and a mineral acid.

11. Process according to claim 10, wherein the acid catalyst is an ammonium or organic amine salt of a mineral acid.

12. Process according to claim 10, wherein the acid catalyst is ammonium chloride.

13. The process of claim 1, wherein the dyestuff is of the formula wherein A is -NX-, $-SO_2NX-$, CONX-, $-(CH_2)_p-$ NHCOX-,

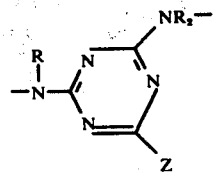

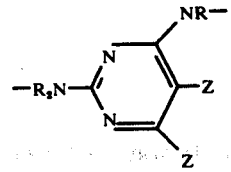

-continued

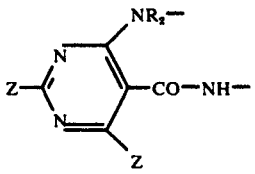

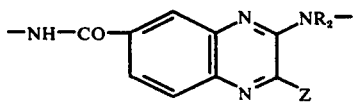

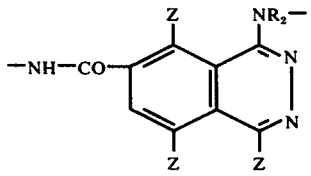

wherein

*p* is 1 or 2,

*R* is hydrogen or an alkyl group having 1 to 4 carbon atoms, $R_2$ is hydrogen or an alkyl group having 1 to 6 carbon atoms or a cycloalkyl radical having at least 1 hydroxyl group, and Z is hydrogen, halogen, lower alkyl, aryl, alkoxy, aryloxy, alkylmercapto, arylmercapto, amino, hydroxyl or a thiocyanate group.

14. The process of claim 1, wherein the dyestuff is of the formula

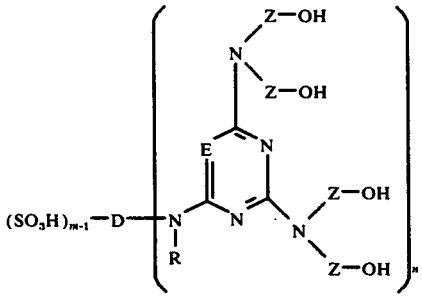

wherein

R is hydrogen or alkyl of 1 to 4 carbon atoms,

D is the radical of an azo or anthraquinone dyestuff,

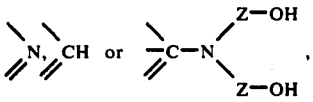

Z is an alkylene radical of 2 to 5 carbon atoms,

*n* is 1 or 2, and

*m* is 1 to 5.

15. The cellulose material dyed or printed and finished according to claim 1.

16. An aqueous liquor containing a. 10 to 100 g/l of a dyestuff of the formula $$(W)_{m-1} - D - [A - X]_n$$

wherein

W is an $SO_3H$ group or a COOH group,

D is a chromophoric radical of a formazan, azomethine, nitro, azo anthraquinone or phthalocyanine dyestuff, A is a bridge member selected from the group consisting of a heterocyclic-aromatic radical, a substituted amine, carbonamido or sulphonamido radical, or an alkyleneaminocarbonyl radical, or a $-SO_2-$ or a —NHCO— group, X is a monohydroxyalkyl radical of 2 to 10 carbon atoms having at least 2 carbon atoms between the hydroxy group and the bridge member,

*m* and *n* are integers of 1 to 5, b. 20 to 60 g/l of a water-soluble or water-dispersible synthetic-resin-forming intermediate selected from the group consisting of an aminotriazine-formaldehyde addition product, an oxydiaminotriazine-formaldehyde addition product, a dioxyaminotriazine-formaldehyde addition product, a triazone-formaldehyde addition product, a guanamine-formaldehyde addition product, a urea-formaldehyde addition product, a thiourea-formaldehyde addition product, an ethyleneurea-formaldehyde addition product, a dicyanodiamide-formaldehyde addition product, methylolmelamine, methylolurea, methylolethyleneurea at least partially etherified with a $C_1$–$C_5$-alkanol, methylolguanylurea at least partially etherified with a $C_1$–$C_5$-alkanol, methylolacetyleneurea at least partially etherified with a $C_1$–$C_5$-alkanol, and 4,5-dihydroxyimidiazolidone-2, c. 5 to 30% of the weight of the dyestuff of formaldehyde or a water-soluble polymeric-form of formaldehyde, and d. an acid catalyst.

* * * * *

UNITED STATES PATENT OFFICE

CERTIFICATE OF CORRECTION

PATENT NO. : 4,009,000

DATED : February 22, 1977

INVENTOR(S) : HERMANN BÜHLER

It is certified that error appears in the above-identified patent and that said Letters Patent are hereby corrected as shown below:

In claim 13, column 25, line 15, between the penultimate and last structural formula, insert -- or --.

In claim 14, column 26, line 5, before "$\geqslant$N," insert -- E is --.

In claim 16, line 24, change "amine" to -- amino --.

Signed and Sealed this

Third Day of May 1977

[SEAL]

*Attest:*

RUTH C. MASON
*Attesting Officer*

C. MARSHALL DANN
*Commissioner of Patents and Trademarks*